US009281645B2

(12) United States Patent
Dinnebier et al.

(10) Patent No.: US 9,281,645 B2
(45) Date of Patent: Mar. 8, 2016

(54) ELECTRICAL SUPPLY CONNECTOR WITH A SIMPLIFIED MOUNTING ARRANGEMENT

(71) Applicant: Selux AG, Berlin (DE)

(72) Inventors: Johannes Dinnebier, Berlin (DE); Jan Blieske, Berlin (DE)

(73) Assignee: Selux AG, Berlin (DE)

( * ) Notice: Subject to any disclaimer, the term of this patent is extended or adjusted under 35 U.S.C. 154(b) by 0 days.

(21) Appl. No.: 14/322,985

(22) Filed: Jul. 3, 2014

(65) Prior Publication Data

US 2015/0079824 A1 Mar. 19, 2015

(30) Foreign Application Priority Data

Jul. 4, 2013 (DE) ..... 20 2013 102 943 U

(51) Int. Cl.

| | |
|---|---|
| ***H01R 25/00*** | (2006.01) |
| ***H01R 25/14*** | (2006.01) |
| ***F21V 21/35*** | (2006.01) |
| ***H01R 13/44*** | (2006.01) |
| ***H01R 31/06*** | (2006.01) |

(52) U.S. Cl.

CPC ..... *H01R 25/142* (2013.01); *F21V 21/35* (2013.01); *H01R 13/44* (2013.01); *H01R 31/06* (2013.01)

(58) Field of Classification Search

CPC ..... H01R 25/142; H01R 31/06; H01R 13/44; H01R 25/14; F21V 21/35

USPC ..... 439/121

See application file for complete search history.

(56) References Cited

U.S. PATENT DOCUMENTS

| | | | | |
|---|---|---|---|---|
| 3,894,781 | A * | 7/1975 | Donato | 439/121 |
| 3,963,294 | A * | 6/1976 | Heritage | 439/121 |

FOREIGN PATENT DOCUMENTS

| | | | |
|---|---|---|---|
| DE | 2114911 | A1 | 9/1972 |
| DE | 2210516 | A1 | 9/1973 |
| DE | 2250738 | A1 | 4/1974 |
| DE | 3902695 | A1 | 8/1990 |
| DE | 69303843 | T2 | 12/1996 |
| DE | 202010004783 | U1 | 9/2011 |
| DE | 202012004156 | U1 | 7/2012 |
| EP | 0074754 | A2 | 3/1983 |
| EP | 0241318 | A2 | 10/1987 |
| GB | 2140983 | A | 12/1984 |

* cited by examiner

*Primary Examiner* — Javaid Nasri
(74) *Attorney, Agent, or Firm* — Harness, Dickey

(57) ABSTRACT

The invention relates to an electrical supply connector having a housing, a contact element on which an electrical port is formed and which is arranged so as to be displaceable inside the housing, in such manner that the contact element is displaceable between an extended position, in which the electrical port protrudes out of the housing in the area of a side surface and an electrical contact can thus be made with a conductor rail via the electrical port, and a retracted position in which the electrical port is arranged inside the housing and the electrical contact is disconnected, and an actuating element that is arranged in the area of a front cover surface on the housing and is displaceable between a release position and a coupling position, in such manner that when the actuating element moves into the coupling position it forces the contact element out of the retracted position and into the extended position thereof. The invention also relates to a system with a current conductor and an electrical supply connector.

14 Claims, 7 Drawing Sheets

ELECTRICAL SUPPLY CONNECTOR WITH A SIMPLIFIED MOUNTING ARRANGEMENT

CROSS-REFERENCE TO RELATED APPLICATIONS

This application claims priority to German application No. 20 2013 102 943.2 filed on Jul. 4, 2013. The disclosure of the above application is incorporated herein by reference.

The invention relates to an electrical supply connector and to a system comprising an electrical supply connector a conductor rail.

BACKGROUND OF THE INVENTION

Electrical supply connectors of such kind are used to couple one or more consumer devices, such as lamps, to a conductor rail, via which electrical energy is supplied and distributed. For this purpose, the electrical supply connector is fastened detachably to the conductor rail. Electrical contact is established by the establishment of an electrical connection between the electrical conductors of the conductor rail and electrical ports of the connector. In addition, the electrical supply connector is fastened to the conductor rail mechanically at regular intervals. An electrical consumer device, such as a lighting apparatus, may be connected via a port arrangement on the electrical supply connector.

A current collector for an electrical conductor rail that comprises a camshaft mechanism for operating attachment fingers and phase contact fingers is known from German Patent No. DE 39 02 695 A1.

German Patent No. DE 22 105 16 discloses a connector for conductor rails in which circular disc segments are used as contact members.

European Patent No. EP 0 241 318 A2 provides for a pivoting actuator in an electrical supply connector, wherein the pivoting actuator may actuate locking elements when moved into an inwardly pivoted position, thereby securing the electrical supply connector mechanically to the conductor rail.

A pivoting component is also provided in an electrical connecting element described in European Patent No. EP 0 074 754 A2. In a starting position, when the pivoting component has been pivoted inward, each of the contact lugs passes through a dedicated opening in the housing in such manner that the contact lugs protrude above the exterior of the housing and are in contact with conductor rail contacts. If the pivoting component is pivoted outward, the contact lugs are retracted into the housing of the connector element with force against biasing force. The connector element may be recessed in the conductor rails or removed therefrom. When the pivoting component is pivoted inward, the contact lugs withdraw from the housing automatically due to the biasing force and, if correct insertion into the conductor rail allows them to pivot completely, close the electrical contacts.

Another electrical supply connector is known from German Patent No. DE 69 303 843 T2. An adjustment device is mounted pivotably on the connector housing, and serves to enable striplike contact arm to be pivoted perpendicularly to the lengthwise direction thereof in such manner that contact tongues can be brought into and out of contact with ladder rails of the conductor rail.

German Patent No. DE 20 2010 004 783 U1 describes an electrical supply connector for fastening a light or spotlight to a U-shaped element. Displaceable actuating elements are arranged on an outer circumferential surface, and serve to move mechanical locking elements and/or electrical contacts from an inwardly pivoted position to an outwardly pivoted position.

German Patent No. DE 2 250 738 A1 discloses a detachable current collector device for a conductor rail with an essentially U-shaped cross section. An actuating lever is pivotable about a change shaft that stands upright on the bottom of a base part and serves to pivot winglike locking elements inwardly and outwardly.

SUMMARY OF THE INVENTION

The object of the invention is to provide an electrical supply connector and a system comprising an electrical supply connector under a conductor rail that help to simplify mounting of the electrical supply connector on the conductor rail. It should be possible to design the electrical contact arrangement and the mechanical fastening as simply as possible.

In order to solve this object, an electrical supply connector was produced. A system having an electrical supply connector and a conductor rail was also provided. Advantageous variants are the subject matter of the dependent claims.

According to one aspect, an electrical supply connector with a housing is provided. The connector housing accommodates a contact element or contact component that has an electrical port. The contact element is arranged so as to be movable inside the housing in such manner that the contact element is displaceable between an extended position and a retracted position. In the extended position, the electrical port projects above the exterior of the housing in the area of a lateral surface, so that an electrical contact with the conductor rail may be established via the electrical port. In the extended position, a section of the contact element with the electrical port is able to pass through an assigned opening in the connector housing. In the retracted position of the contact element, the electrical port is withdrawn into the housing and the electrical contact is interrupted, the electrical supply connector can be disconnected from the conductor rail or inserted therein.

In order to actuate the contact element, the electrical supply connector is equipped with an actuating element that is arranged on the housing. The actuating element is arranged in the area of a front covering surface on the housing, and may be switched between a separating position and a coupling position, such that when switching into the coupling position the actuating element irresistibly moves the contact element from the retracted position into the extended position, so that the electrical contact of the electrical supply connector may be created with the conductor rail. The forcible displacement action of the actuating element is such that, when the actuating element switches to the coupling position, the contact element is moved irresistibly into the extended position and the electrical contact may be created between the electrical supply connector and the conductor rail. In this way, a kind of automatic protection against incorrect installation of the connector in the conductor rail is assured. If the electrical supply connector is not inserted in the conductor rail in a functionally correct manner, and consequently no assigned space/contact is available in the conductor rail for the one or more elements with electrical port that are to be extended, the element cannot be moved into the extended position, or at least only partially, and this in turn means that the actuating element cannot be moved into the coupling position. The user is thus alerted to the possibility that it has been installed incorrectly in the conductor rails.

The electrical contacting by means of the electrical port and/or the mechanical mounting by means of the locking element may provide for the formation of a positive locking connection with an assigned conductor rail element.

A connection arrangement is provided on the adapter housing, and is designed to enable connection of a consumer device, for example a lighting device such as a lamp. The connection arrangement may be disposed in the area of a front covering surface of the housing. The connection arrangement may be created with a section projecting away from the housing. The consumer device may be coupled to the energy supply via a conductor rail via the connection arrangement of the electrical supply connector.

According to a further aspect, a system is created having a conductor rail and an electrical supply connector, wherein the electrical supply connector on the conductor rail is inserted into an assembly space and contact is established in such manner that a housing of the electrical supply connector is entirely enclosed in the assembly space. The system is not limited to the use of an electrical supply connector of the type described in the preceding. It would also be very easy to provide for the insertion of variations of the electrical supply connector in the assembly space, for which the housing of the electrical supply connector is then enclosed completely and detachably in the assembly space. A swivel axis of an actuating element on the electrical supply connector may lie in a boundary surface of the assembly space through which the electrical supply connector is routed into the assembly space. Alternatively, the swivel axis may lie in a surface at a distance and parallel thereto, particularly into the assembly space.

In one embodiment, a trim component may be arranged on the opposite side of a front cover surface of a housing of the electrical supply connector, optionally lying flush with the front cover surface, wherein a mounting slot in the trim component has essentially the same width as a width of the electrical supply connector housing when looking toward the front cover surface. Such a configuration may be provided in conjunction with the aforementioned system, for example.

At least in the coupled position, the actuating element may be disposed to lie flush with the front cover surface. For example, an actuating element that is pivotable or mounted so as to be rotatable may be provided to assure a flush fitting structure.

With regard to actuating the actuating element, it may be provided that this is only permitted in the area of the front cover surface, so that a mechanism for working (operating) the actuating element is free from other operating means that would enable operation in the area of other housing sections.

The actuating element may be designed to be operable without a tool, thereby providing an actuating element that may be operated without or independently of a tool.

The contact element may be designed as a combination element, on which a fastening element is also conformed besides the electrical port, in such manner that in the extended position a retaining contact with the conductor rail may be formed via the fastening element, and in the retracted position the retaining contact is released. The combination element thus not only serves to ensure that electrical contacts are maintained when the electrical supply connector is arranged inside a conductor rail, but also provides mechanical fastening of the electrical supply connector to the conductor rail, optionally to the point of mechanical locking (if designed as a locking element). When the actuating element switches into the coupling position, the combination element is moved irresistibly into the extended position, so that both the electrical contact and the mechanical fastening of the electrical supply connector with the conductor rail can be assured.

It may be provided that the coupling position of the actuating element and the extended position of the element are functionally interdependent, in such manner that the contact element, even in the variant as a combination element, for example, is associated with the extended position (the end position assigned to the element) when the actuating element is in the coupling position (the end position assigned to the actuating element). If the contact element is not able to reach the extended position, it is also not possible to (fully) actuate the actuating element, that is to say to switch it to the coupling position.

In one variation, the actuating element may be pivotable on the housing about an axis extending between the released position and the coupling position. In one variation, it may be provided that the actuating element is mounted on the housing with so as to be pivotable by means of a film hinge. In this case, the release position may coincide with an outwardly pivoted position, and the coupling position with an inwardly pivoting position.

In an alternative variant, the actuating element may be configured as actuating element that is displaceable along a straight track, for example as a slider or movable button, wherein the track extends preferably vertically between the positions of the actuating element on the front cover surface of the housing.

The contact element may be pretensioned to prevent displacement toward the extended position. The pretensioning may cause the contact element to return automatically to the retracted position (starting position) when the actuating element is shifted from the coupling position into the release position. The pretensioning may be provided for example with the aid of a spring mechanism. Alternatively or in addition thereto, the pretensioning may be produced by the bending stiffness of the contact element itself.

One embodiment provides that with the combination element the electrical port and the fastening element are conformed on the same protrusion. Both the electrical port and the fastening or locking element may be created with a single protrusion. Alternatively, the electrical port and the fastening element may be constructed separately, and preferably at a distance from one another, on the combined element. In one configuration, multiple protrusions may be arranged on the combined element, and the electrical port and fastening element are created on or with said protrusions independently of one another.

The contact element may be mounted pivotably in such manner that the contact element is able to pivot between the extended position and the retracted position. The ability of the contact element to pivot may be assured for example with the aid of a material section that is elastically flexible. For example, at least sections of the combination element, as well as other components of the electrical supply connector as desired, may be made as an injection moulded part.

At least sections of the contact element may be formed by means of a printed circuit board. The contact element may consist of a printed circuit board, which may be mounted pivotably or it may comprise a pivotable section.

In one variation, a locking device may be provided that is capable of locking the actuating element at least in the coupling position. Then, with the actuating element locked in the coupling position, the contact element is also secured in the extended position. The locking device may be constructed with a button lock. For example a locating lug may clasp behind a section of the adapter housing when the actuating element is in the coupling position. The locating lug may be conformed on a flexible section, which is subjected to a button pressure to release the locking position in order to cancel the clasping action.

One embodiment provides that a forcing element is arranged on the actuating element and is assigned to the contact element, and comprises a wedge-like section that cooperates with the contact element during its transition into the coupling position to shift the contact element into the extended position. The construction of the forcing element with the wedge-like section may cause the contact element to gradually shift into the extended position as the actuating element switches to the coupling position. It may be provided that the wedge-like section on the forcing element cooperates with a corresponding wedge-like part on the contact element. The corresponding wedge-like part may be constructed integrally with the contact element, for example in an element section in which the electrical port and/or the fastening element are conformed on the contact element.

The actuating element may comprise a base section, with which a displaceable housing section is formed. The forcing element may be designed to protrude from the base section, and arranged in the housing at least in the coupling position. In the release position, an opening on the adapter housing is made free. The base section of the actuating element may be arranged on the front cover surface of the housing. In the coupling position, the base section may completely close off the associated housing opening.

A refinement thereof may provide a protective device that prevents the contact element from being shifted into the extended position if the installation in a conductor rail has not been completed in functionally proper manner, and permits shifting of the contact element into the extended position if the installation in a conductor rail has been completed in functionally proper manner. The protective device may function as reverse polarity protection, since it ensures that the electrical supply connector will always be inserted in the conductor rail in functionally proper manner.

In one variation, it may be provided that the protective device has a probe element that is assigned to a corresponding element in the conductor rail, in such manner that the shift of the actuating element into the coupling position is permitted when the probe element is in contact with and/or engages in the corresponding element, and the shift of the actuating element into the extended position is also blocked. The probe element may be designed with a protrusion that interacts with the corresponding element, which may be a protrusion or a recess.

One embodiment provides that a feeler tab is arranged on the electrical port of the contact element, and depending on the shape and/or spatial orientation of the feeler tab, it allows engagement with the assigned contact section on the conductor rail when insertion in a conductor rail is carried out in functionally proper manner, but otherwise prevents it.

It may be provided that the electrical port and/or the fastening element are designed as a flat or disc-shaped component. In one configuration, a retractable and extendable contact tongue serves to ensure the electrical contact with the conductor rail and/or the mechanical fastening of the electrical supply connector on the conductor rail.

It may further be provided that the displacement of the contact element, particularly of the electrical port and/or the fastening element, takes place in a plane transverse to the lengthwise extension of the housing.

The connection arrangement on the electrical supply connector may include a socket or threaded bush for coupling a consumer device. Parts of the connection arrangement may protrude out of the adapter housing. When the electrical supply connector is assembled with the conductor rail, the parts of the connection arrangement that protrude outside of the adapter housing may be arranged inside or outside the assembly space on the conductor rail in which the electrical supply connector is arranged.

It may be provided that the shape of an external part of the housing section of the electrical supply connector, particularly in the area of a rear cover surface that is to say on the side opposite the front cover surface, is adapted to match a corresponding surface shape in the assembly space of the conductor rail, for example in the area of a bottom of the conductor rail, which may optionally have an asymmetrical construction. This design, alternatively or in addition to the variations described in the preceding, offers further protection against functionally improper insertion of the electrical supply connector in the conductor rail. The mating and shape-matched sections on the adapter and the rail make installation impossible if the adapter is not inserted correctly.

DESCRIPTION OF EMBODIMENTS

In the following, more embodiments will be explained in greater detail with reference to the figures of a drawing. In the drawing:

FIG. 1 shows perspective representations of an electrical supply connector,

FIG. 2 shows schematic representations of the operation of an actuating element in the electrical supply connector of FIG. 1, FIG. 3 shows schematic representations intended to explain a locking mechanism, FIG. 4 shows a schematic representation of a section of an electrical supply connector with two-sided locking and contacting in the retracted and extended positions, FIG. 5 shows schematic representations of an inner part, an outer shell and an assembled electrical supply connector system, FIG. 6 shows a schematic representation intended to explain a protection device, FIG. 7 shows schematic representations for further explanation of the protection device, and FIG. 8 shows a schematic representation of a system with a conductor rail, and an electrical supply connector with which a lighting device is coupled, mounted thereon.

FIG. 1 shows perspective representations of an electrical supply connector with a housing 1, which is made from a plastic material and is produced for example as an injection moulded part. A connection arrangement 3, via which a consumer device (not shown), for example a lamp, may be connected, is arranged on underside 2.

Underside 2 (front cover surface) is also furnished with an actuating element 4 arranged on adapter housing 1 so as to be pivotable by means of a film hinge 5. The upper part of FIG. 1 shows actuating element 4 in an outwardly swivelled position, so that a housing opening 6 is partially freed. Actuating element 4 comprises a base section 7 which forms a housing section. A wedge-shaped element 8 is arranged on the inwardly facing surface of base section 7. A tactile locking mechanism 9 is provided, with which actuating element 4 is secured in the inwardly swivelled position (see bottom of FIG. 1).

Multiple housing openings 11 are provided on a side wall 10, and electrical ports 12 or a fastening element 13 pass through these (see bottom of FIG. 1) when actuating element 4 is brought into the inwardly pivoted position. The extension of electrical port 12 and of fastening elements 13 is brought about irresistibly by the action of wedge-shaped element 8 pressing against a combination element 14, in which both the electrical ports 12 and fastening element 13 are located in the embodiment shown. When actuating element 4 is in the outwardly swivelled position as in the top illustration in FIG. 1, combination element 14 is in a retracted position, such that electrical ports 12 and fastening element 13 are accommodated in adapter housing 1 and do not protrude outside it. The electrical supply connector may then be inserted in the conductor rail (not shown) or removed therefrom.

As shown in FIG. 1, the electrical supply connector is furnished with a grounding lug 15. A spring element 16 is also provided, and this engages in an assigned mechanical groove when the connector is inserted in the conductor rail.

The forced extension of combination element 14 with the electrical ports 12 and fastening element 13, optionally against a pretensioning force, is shown schematically in FIG. 2.

Figure 1:
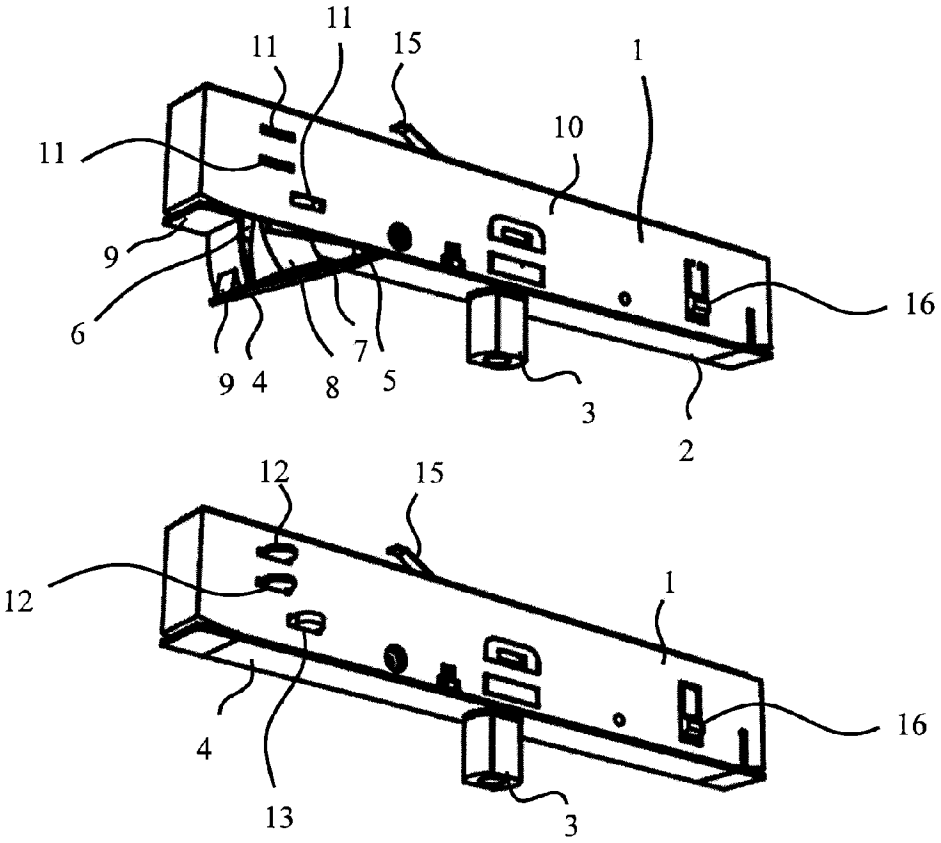
Figure 2:
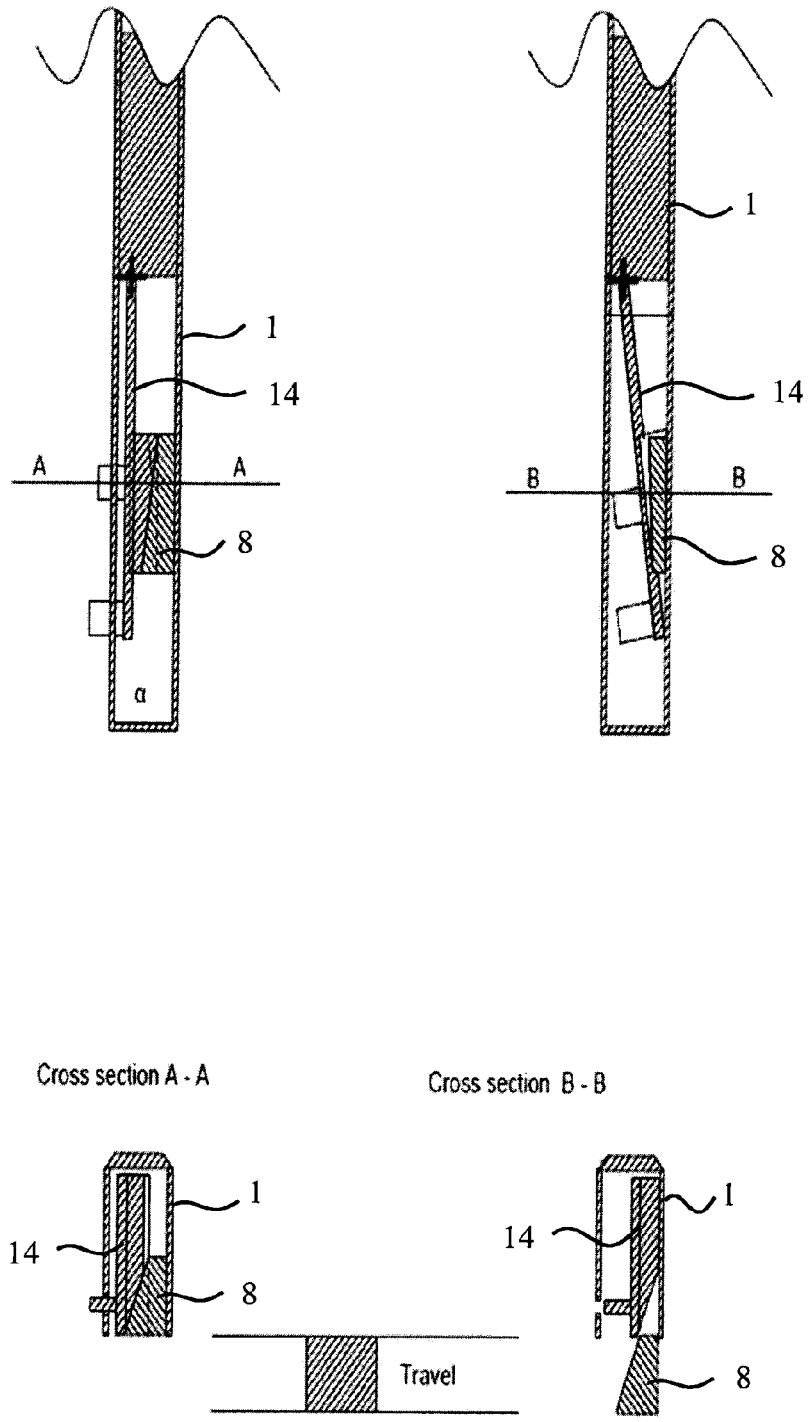
Figure 3:
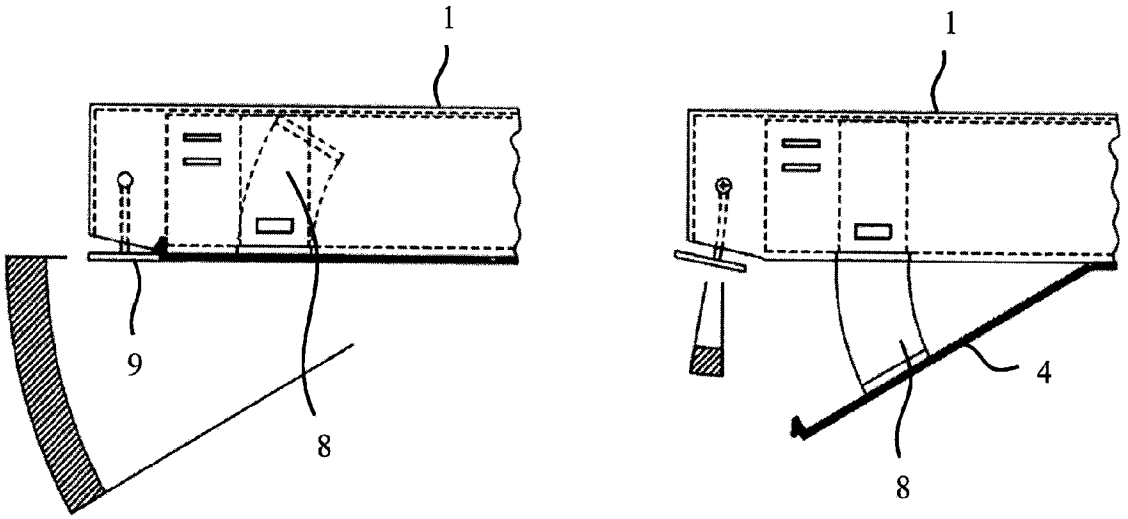
FIG. 3 shows schematic representations of a section of the electrical supply connector, wherein the actuating element is shown in the inwardly pivoted and the outwardly pivoted positions.
Figure 4:
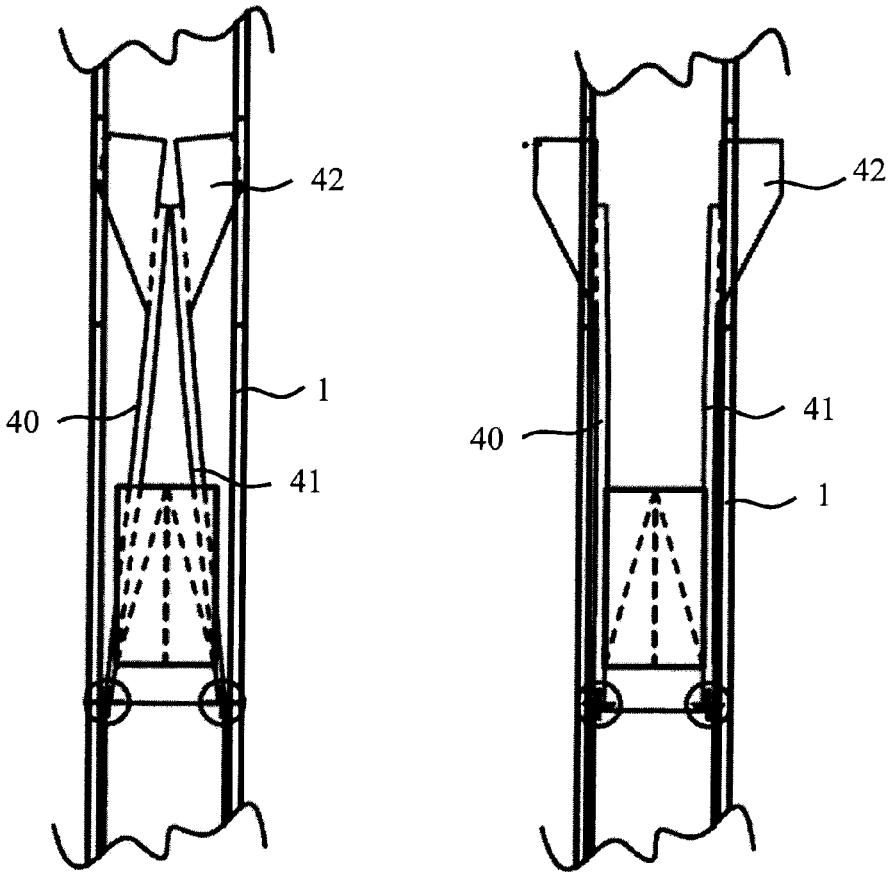
FIG. 4 shows a schematic representation of a section of an electrical supply connector, in which two combination elements 40, 41 are shifted at the same time with the aid of the actuating element, in such manner that locking and/or contacting with the conductor rail takes place on both sides.
Figure 5:
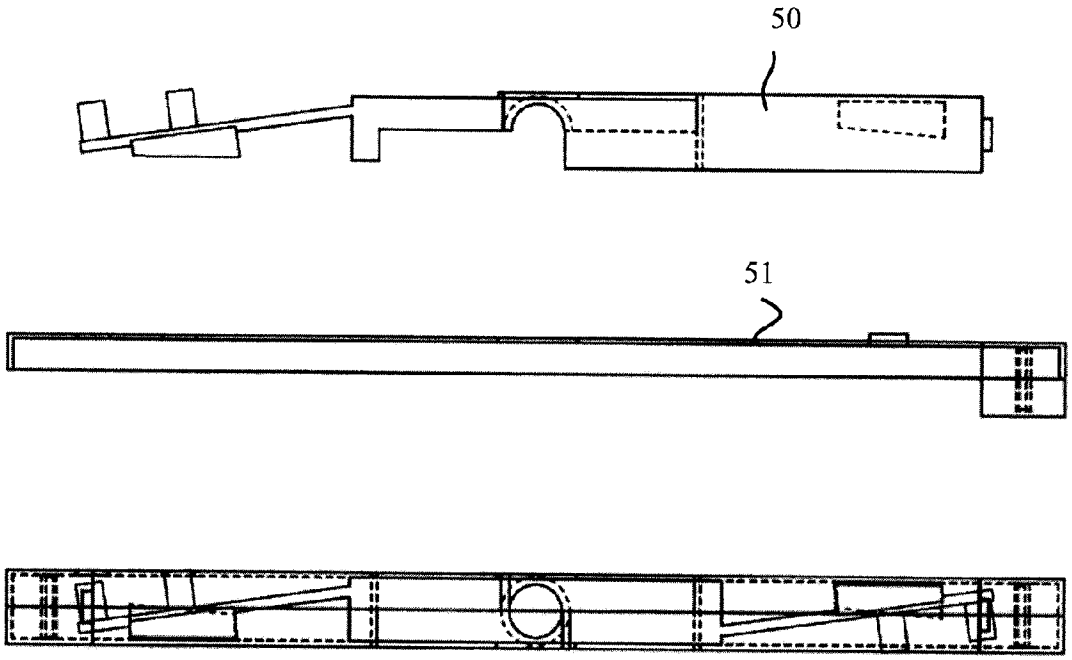
FIG. 5 shows a schematic representation with an inner part 50 and an outer shell 51, both as individual components and in the assembled condition.
Figure 6:
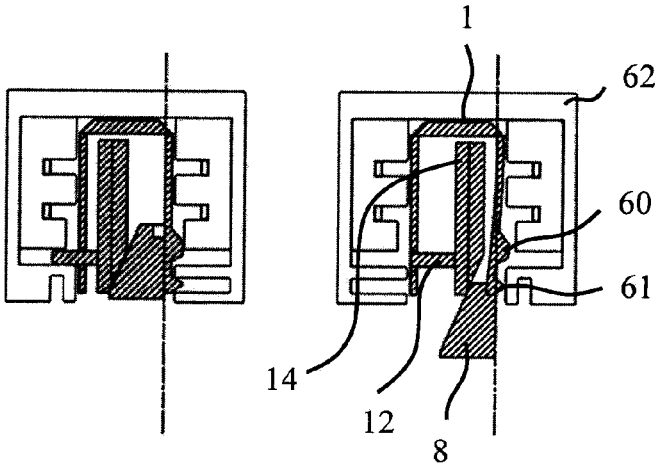
Figure 7:
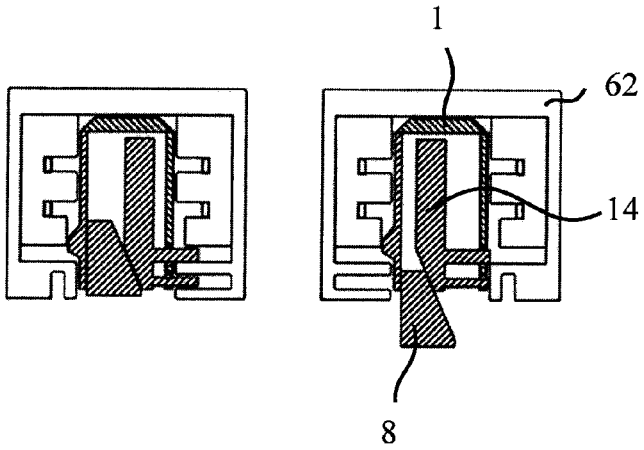

FIGS. 6 and 7 show schematic representations designed to explain a protective device that is created with a snap-in point 60 and a feeler tab 61. Wedge-shaped element 8 is not able to force combined element 14 and therewith electrical port 12 (not shown) and the fastening element out of adapter housing 1 until snap-in point 60 and feeler tab 61 have reached assigned counterpart components in conductor rail 62 (see left-hand diagrams in FIGS. 6 and 7).

Figure 8:
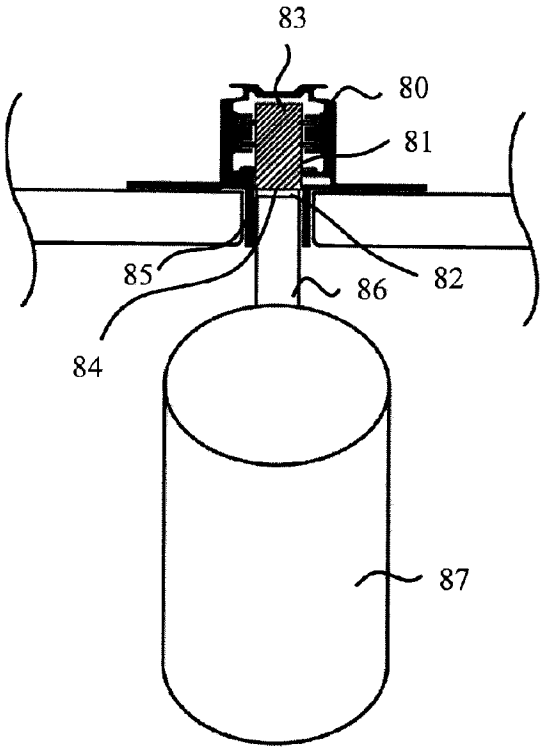

FIG. 8 is a schematic representation of a system with a conductor rail 80, in which an electrical supply connector 83 is accommodated in an assembly space 81 that is open at the front 82, so that electrical supply connector 83 is enclosed completely, that is to say particularly with its entire housing, in assembly space 81. Electrical supply connector 83 may be for example an electrical supply connector in one of the variations described previously. A front cover surface 84 of electrical supply connectors 83 is arranged flush with front side 82 of conductor rail 80. A trim component 84 with a mounting slot 85 is arranged on front side 82 of conductor rail 80. A connecting component 86 for a lighting device 87 is routed through mounting slot 85. Mounting slot 85 has essentially the same width as a width of the housing of electrical supply connector 80 when looking toward front cover surface 84. Electrical supply connector 80 may simply be fed through mounting slot 85 to assemble and disassemble it.

The features disclosed in the preceding description, and in the claims and the drawing may be significant for the realisation of different variations either individually or in any combination thereof.

The invention claimed is:

1. Electrical supply connector, comprising:

a housing, a combination element having an electrical port formed thereon and arranged so as to be displaceable inside the housing, in such manner that the combination element is displaceable between an extended position, in which the electrical port protrudes out of the housing in the area of a side surface and an electrical contact can thus be made with a conductor rail via the electrical port, and a retracted position in which the electrical port is arranged inside the housing, and an actuating element that is arranged in the area of a front cover surface on the housing and is displaceable between a release position and a coupling position, wherein the actuating element includes a wedge-shape section engaged with the combination element such that the combination element moves from the retracted position to the extended position in response to the actuating element moving from the release position to the coupling position.

2. Electrical supply connector according to claim 1, wherein the combination includes a fastening element formed besides the electrical port and configured to engage the conductor rail when the combination element is in the extended position.

3. Electrical supply connector according to claim 2, wherein combination element, and the actuating element are integrally formed together.

4. Electrical supply connector according to claim 2 wherein the actuating element has a base section with which a displaceable housing section is formed.

5. Electrical supply connector according to claim 1 wherein the actuating element is pivotable on the housing between the release position and the coupling position about an axis extended perpendicularly to the longitudinal extension of the housing.

6. Electrical supply connector according to claim 1 wherein the combination element is mounted so as to be pivotable, in such manner that the combination element is able to pivot between the retracted position and the extended position.

7. Electrical supply connector according to claim 1 wherein at least sections of the combination element are formed by means of a printed circuit board.

8. Electrical supply connector according to claim 1 further comprises a locking device that is designed to lock the actuating element at least in the coupling position.

9. Electrical supply connector according to claim 1 wherein the combination element is biased against displacement toward the extended position.

10. Electrical supply connector according to claim 1 further comprises a feeler tab arranged on the electrical port of the combination element, which by the shape or spatial orientation thereof allows the electrical port to engage with the conductor rail when insertion in the conductor rail is carried out in functionally proper manner, but otherwise prevents it.

11. Electrical supply connector according to claim 1 further comprises a protection device, which prevents the combination element from being shifted into the extended position in the event of functionally improper insertion in the conductor rail, and allows the combination element to be shifted into the extended position if the device was inserted in the conductor rail in functionally proper manner.

12. Electrical supply connector according to claim 11 wherein the protective device comprises a feeler element that is assigned to a counterpart component in the conductor rail, in such manner that the displacement of the combination element into the extended position is permitted when the feeler element rests on the counterpart component or engages therein, and otherwise the displacement of the combination element into the extended position is blocked.

13. System having conductor rail and the electrical supply connector according to claim 1 wherein the electrical supply connector is inserted and electrically contacted in an assembly space on the conductor rail, in such manner that the housing of the electrical supply connector is entirely contained inside an installation space.

14. System according to claim 13 further comprises a trim component arranged opposite a front cover surface of the housing of the electrical supply connector, wherein a mounting slot in the trim component has a slot width that is essentially the same as a width of the housing of the electrical supply connector when viewed in the direction towards the front cover surface.

* * * * *